US006854887B2

(12) United States Patent
Anderson

(10) Patent No.: US 6,854,887 B2
(45) Date of Patent: Feb. 15, 2005

(54) SLIDER WITH ARM

(75) Inventor: Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 0 days.

(21) Appl. No.: 10/225,026

(22) Filed: Aug. 20, 2002

(65) Prior Publication Data

US 2004/0037478 A1 Feb. 26, 2004

(51) Int. Cl.[7] ..... B65D 33/16
(52) U.S. Cl. ..... 383/64; 24/399
(58) Field of Search ..... 383/69; 24/399, 24/400

(56) References Cited

U.S. PATENT DOCUMENTS 3,054,434 A * 9/1962 Ausnit et al. ..... 383/65
3,115,689 A * 12/1963 Jacobs ..... 24/399
3,122,807 A * 3/1964 Ausnit ..... 24/399
3,213,505 A * 10/1965 Ausnit et al. ..... 24/428
3,324,520 A * 6/1967 Ausnit ..... 24/399
3,426,396 A * 2/1969 Laguerre ..... 24/427
3,430,329 A * 3/1969 Ausnit ..... 29/408
3,790,992 A 2/1974 Hertz
3,986,914 A 10/1976 Howard
4,523,918 A 6/1985 Ausnit
4,534,752 A 8/1985 Ferret et al.
4,620,320 A 10/1986 Sullivan
5,020,194 A 6/1991 Herrington et al.
5,067,208 A 11/1991 Herrington et al.
5,088,971 A 2/1992 Herrington et al.
5,131,121 A 7/1992 Herrington et al.
5,161,286 A 11/1992 Herrington et al.
5,301,395 A 4/1994 Herrington et al.
5,405,478 A 4/1995 Richardson et al.
5,426,830 A 6/1995 Richardson et al.
5,442,837 A 8/1995 Morgan
5,448,807 A 9/1995 Herrington, Jr.
5,482,375 A 1/1996 Richardson et al.
5,669,715 A 9/1997 Dobreski et al.
5,722,128 A 3/1998 Toney et al.
5,769,772 A 6/1998 Wiley
5,809,621 A 9/1998 McCree et al.
5,833,791 A 11/1998 Brynairski et al.
5,836,056 A 11/1998 Porchia et al.
5,896,627 A 4/1999 Cappel et al.
5,924,173 A 7/1999 Dobreski et al.
5,947,603 A 9/1999 Tilman
5,950,285 A 9/1999 Porchia et al.
5,956,815 A 9/1999 O'Connor et al.
5,991,980 A 11/1999 Meager
6,178,602 B1 1/2001 Burke et al.
6,286,189 B1 9/2001 Provan et al.
6,286,191 B2 9/2001 Van Erden
6,286,999 B1 9/2001 Cappel et al.
6,287,001 B1 9/2001 Buchman
6,293,701 B1 9/2001 Tomic
6,327,754 B1 12/2001 Belmont et al.
6,347,437 B2 2/2002 Provan et al.
6,357,914 B1 3/2002 Kinigakis et al.
6,361,213 B2 * 3/2002 Randall ..... 383/64
6,364,530 B1 4/2002 Buchman
6,378,177 B1 4/2002 Athans et al.
6,389,780 B1 5/2002 Coomber et al.
6,412,254 B1 7/2002 Tilman et al.
6,431,754 B1 8/2002 Svicki, Sr.
6,449,924 B2 9/2002 McMahon et al.
6,461,042 B1 10/2002 Tomic et al.
6,526,632 B1 * 3/2003 Blythe et al. ..... 24/400

* cited by examiner

*Primary Examiner*—Jes F. Pascua
(74) *Attorney, Agent, or Firm*—Everest Intellectual Property Law Group; Joseph A. Fuchs

(57) ABSTRACT

The present invention provides a recloseable bag having a mouth and including a zippered closure at the mouth. The zippered closure has a first end and a second end. The bag also includes a slider having a body with having a first edge and a second edge. The slider is movable along the zippered closure. An arm extends from one of the first edge or second edge of the slider body. The arm includes a distal end.

21 Claims, 4 Drawing Sheets

SLIDER WITH ARM

BACKGROUND OF THE INVENTION

The present invention relates to airtight zippered bags, and more particularly, to a slider used in connection with such bags. It is known to use airtight plastic bags and containers to conveniently store bulky materials such as clothing and bedding. Airtight plastic bags are also known to store food and other materials. Examples of such airtight bags are disclosed in U.S. Pat. Nos. 6,357,915; 6,116,781; and 5,480,030, each of which is incorporated herein by reference. Airtight bags allow air to be removed from bulky items such as comforters and sweaters, and the bag sealed to essentially "shrink" the items stored inside the bag. Air can be compressed from the contents, for example, by rolling the contents prior to closing the bag. The bags may also have a one-way valve through which a vacuum attachment can be affixed to evacuate the air from inside the bag using a conventional household vacuum cleaner. Removal of air reduces the amount of space necessary to store the items. The bags are typically made of materials such as bi-axial layers of nylon and polyethylene to make the bags air and moisture impermeable, and hold the airtight vacuum seal.

The bags have an airtight zippered closure at the mouth of the bag. An example of an airtight zippered closure is disclosed in U.S. Pat. No. 6,033,113, incorporated herein by reference. Often associated with the zippered closure is a slider that facilitates sealing the airtight zippered closure. The slider closes and can open the zippered closure. Examples of prior art sliders include those disclosed in U.S. Pat. Nos. 6,306,071; 6,287,001; 6,264,366; 6,247,844; 5,950,285; 5,924,173; 5,836,056; 5,442,837; 5,161,286; 5,131,121; 5,088,971; and 5,067,208.

Many of these prior art sliders for zippered closures deform or penetrate the zippered closure causing the bag or zippered closure to leak. Thus, the prior art sliders do not ensure the bag will be airtight.

SUMMARY OF THE INVENTION

The present invention provides a recloseable bag having a mouth and including a zippered closure at the mouth. The zippered closure has a first end and a second end. The bag also includes a slider having a body with a first edge and a second edge. The slider is movable along the zippered closure. An arm extends from one of the first edge or second edge of the slider body. The arm includes a distal end.

In another aspect, the present invention provides a slider for a recloseable bag having a mouth and a zippered closure at the mouth. The zippered closure has a top edge and a bottom edge. The slider includes a body having a first edge and a second edge. An arm extends from one of the first edge or the second edge of the body. The the arm includes a distal end adapted to engage the top edge of the zippered closure.

In a further aspect, the present invention provides a method of opening and closing a recloseable bag having a mouth and a zippered closure at the mouth. The zippered closure includes a top edge and a bottom edge. The method includes the steps of sliding a body along the zippered closure, the body having an arm extending from a first edge or second edge, and the arm having a distal end. During the step of sliding, the distal end of the arm engages the top edge of the zippered closure.

The slider of the present invention does not penetrate the zippered closure, thus ensuring the airtightness of the bag.

Additional features and advantages of the present invention are described in, and will be apparent from, the following Detailed Description of the Invention and the figures.

DETAILED DESCRIPTION OF THE INVENTION

Figure 1:
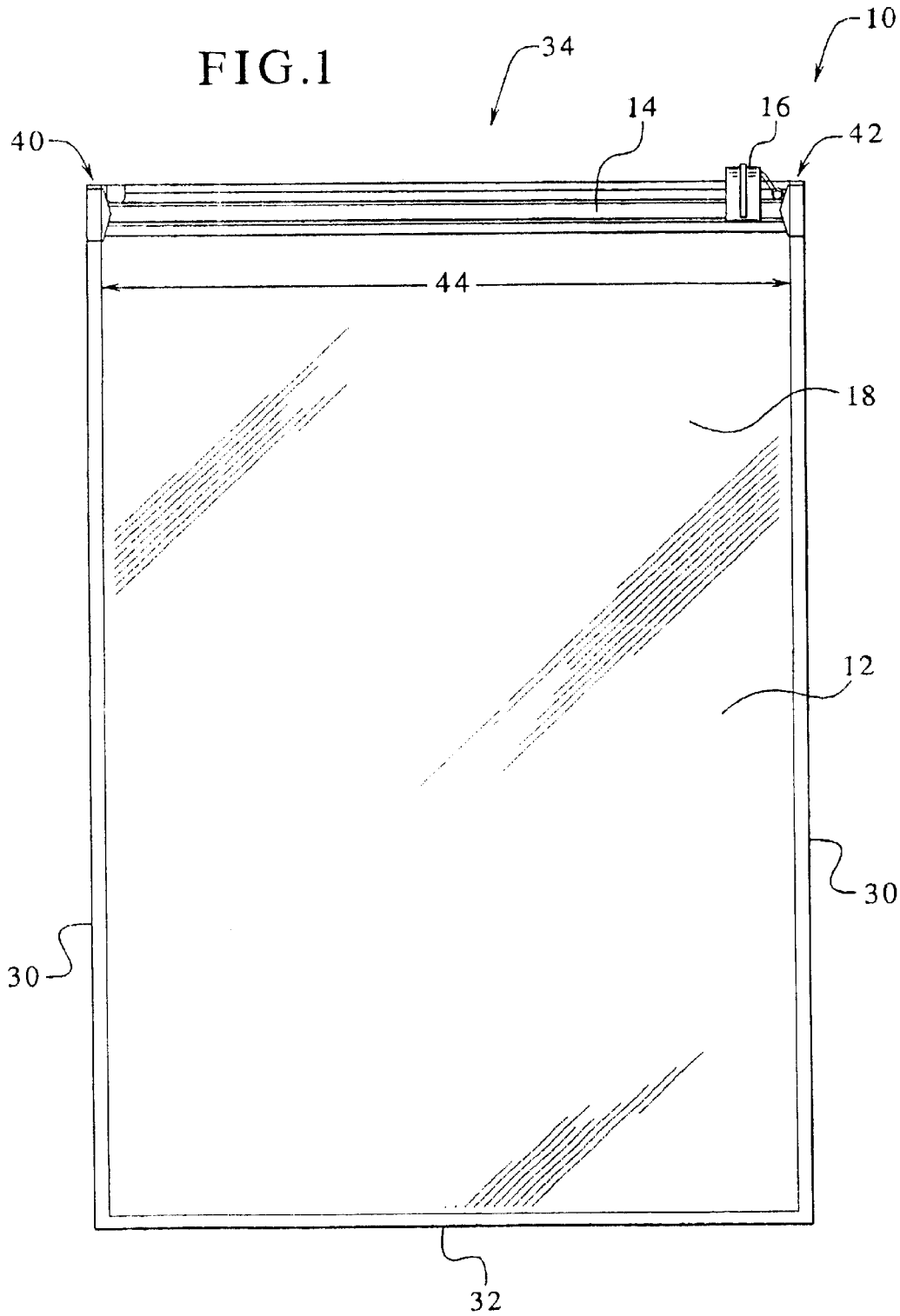
FIG. 1 is a plan view of a bag in accord with an embodiment of the present invention.
Figure 5:
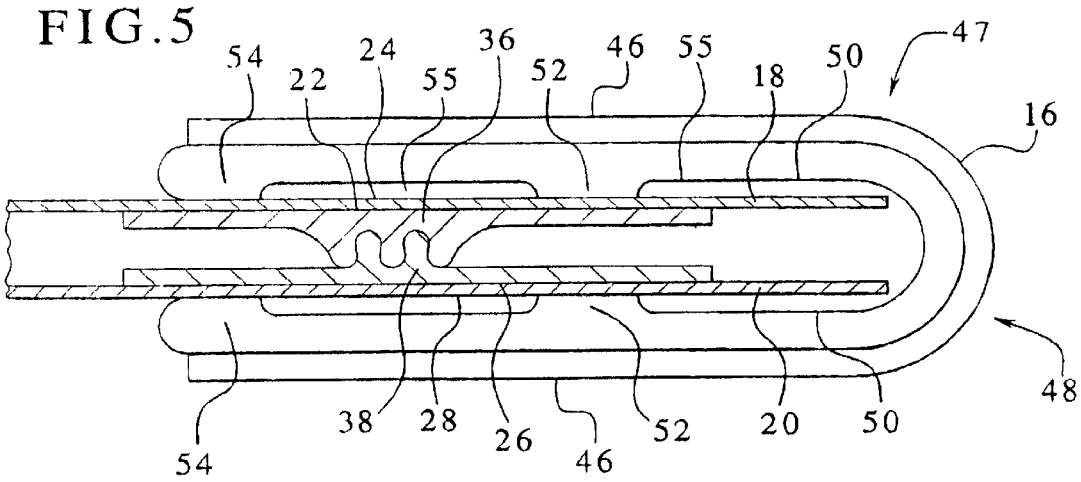
FIG. 5 is an end view of the bag, zippered closure, and slider of an embodiment of the present invention.

FIG. 1 shows a bag assembly 10 made in accord with an embodiment of the present invention. The bag assembly 10 includes a bag 12, a zippered closure 14, and a slider 16. The bag 12 is formed from a front 18 and a back 20. The front 18 has an inner surface 22 and an outer surface 24. The back 20 has an inner surface 26 and an outer surface 28 (FIG. 5).

The front 18 and back 20 are preferably placed in registration and sealed along their side edges 30 and bottom 32 to form the bag 12. Any suitable means to seal the front 18 and back 20 may be used, but they are preferably heat sealed. The bag 12 has a mouth 34 which is not sealed.

The front 18 and back 20 may be a monolayer structure or a multiple layer structure. The multiple layer structures can be formed by coextrusion, extrusion, lamination, extrusion lamination, or other processes well known in the art. The front 18 and back 20 are preferably each made from bi-axial layers of polyethylene and nylon, but may be any suitable material or combination of materials, and may, in one embodiment, be airtight.

FIGS. 2–8 show enlarged views of the bag 12, zippered closure 14, and slider 16. The zippered closure 14 is located at a mouth 34 of the bag 12, and seals the mouth 34. The zippered closure 14 includes a front zipper profile 36 attached to the inner surface 22 of the front 18, and a back zipper profile 38 attached to the inner surface 26 of the back 20. The front zipper profile 36 and back zipper profile 38 are preferably heat sealed to the inner surfaces 22 and 26 of the front 18 and back 20, but may be attached using any suitable means, including adhesives. The front zipper profile 36 and back zipper profile 38 interlock to provide an airtight seal at the mouth 34 of the bag 12. The front zipper profile 36 and back zipper profile 38 are preferably configured and interlock as disclosed in U.S. Pat. No. 6,033,113.

The zippered closure 14 has a first end 40 and a second end 42 defining a length 44. The zippered closure 14 also has top edge 43 and a bottom edge 45 defining a width 41. The first end 40 and second end 42 of the zippered closure 14 are each melted, or "crushed," using heat sealing or ultrasonic sealing and pressure to define crushed sections 49. "Crushing" is conventional in the art.

As shown in FIG. 5, the slider 16 has a body 47 including pair of legs 46 extending from opposite sides of a rounded portion 48. The legs 46 each have an inner profile 50 that permits them to seat on the zippered closure 14. The inner profile 50 has opposing top protrusions 52 and opposing bottom protrusions 54. The top protrusions 52 are above the zippered closure 14 and the bottom protrusions 54 are below the zippered closure 14. The slider 16 moves along the zippered closure 14 to open and close the zippered closure 14. The top and bottom protrusions 52 and 54 contact the outer surfaces 24 and 28 of the front 18 and back 20. The slider 16 has a first edge 51 and a second edge 53. The slider 16 is preferably made of a plastic material, and in a preferred embodiment is made of polyethylene, but may be made of any suitable material. A recessed portion 55 of each leg 46 accommodates the first and second zipper profiles 36 and 38.

The slider 16 has an arm 56 extending from one of either the first edge 51 or second edge 53. Here, the arm 56 is shown attached to the second edge 53. The arm 56 has a distal end. The distal end preferably includes an enlargement 60. The enlargement 60 is preferably ball-shaped, but may be any suitable shape, such as triangular.

Figure 2:
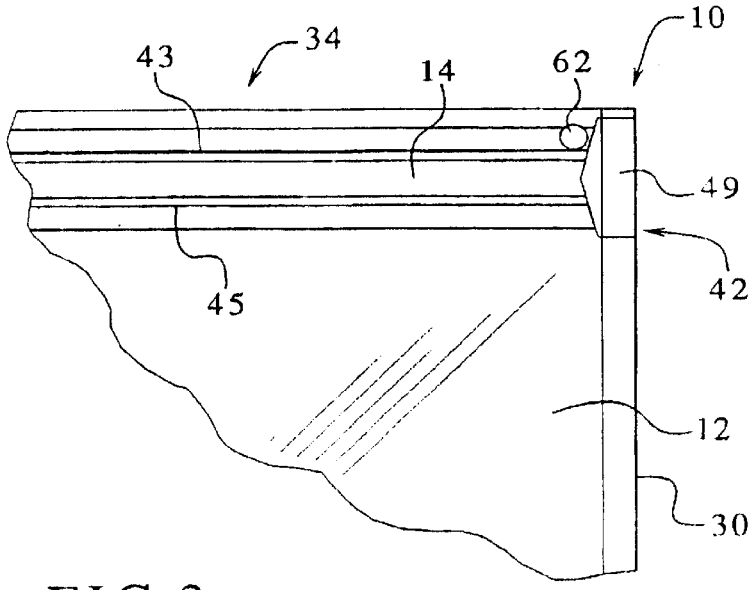
FIG. 2 is an enlarged plan view of one end of the bag of FIG. 1.

FIG. 2 shows the bag 12 and the second end 42 of the zippered closure 14. At the second end 42 is an opening 62 in the bag 12. The opening 62 is located above the top edge 43 of the zippered closure 14.

Figure 3:
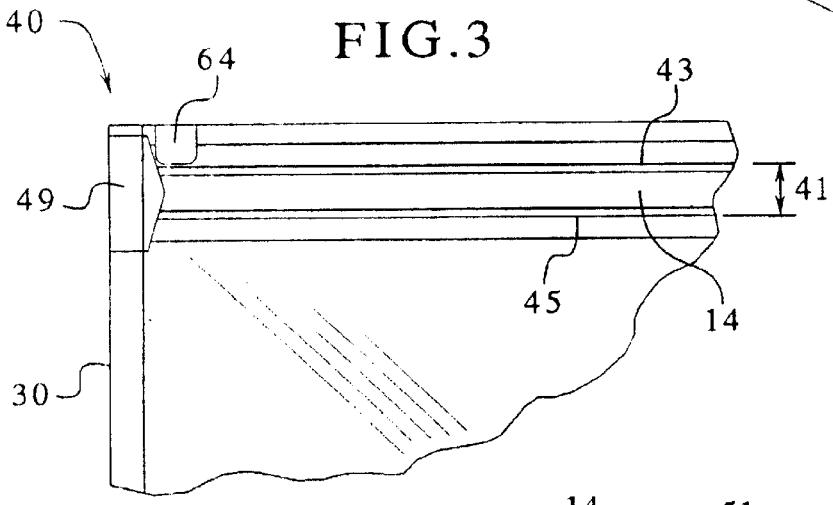
FIG. 3 is an enlarged plan view of the other end of the bag of FIG. 1.

FIG. 3 shows the bag 12 and the first end 40 of the zippered closure 14. At the first end 40 is a seal 64. The seal 64 is created preferably by heat sealing a portion of the front 18 and back 20, though the seal may be created by any suitable means.

Figure 4:
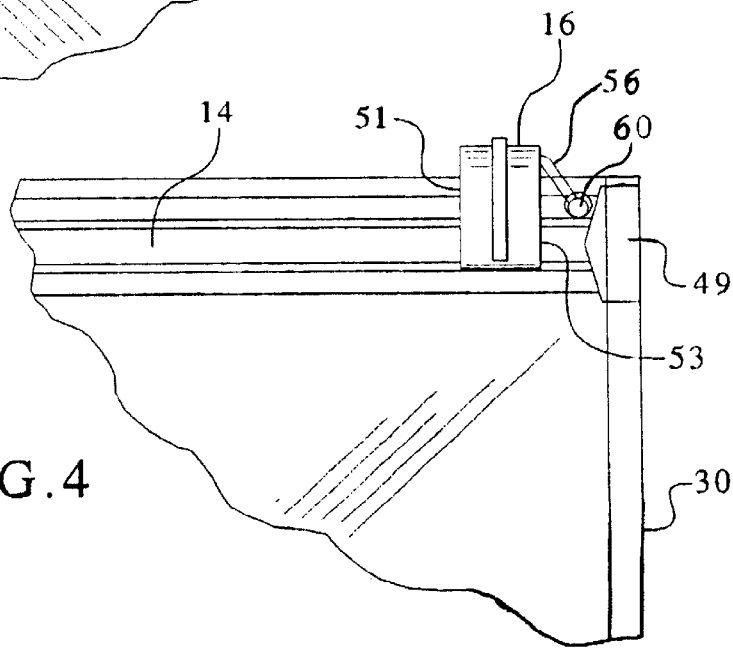
FIG. 4 is a further enlarged plan view of the bag of FIG. 1.

FIG. 4 illustrates the slider 16 with the arm 56 seated in the opening 62 at the second end 42 of the bag 12 after the slider 16 has closed the mouth 34 of the bag 12. To close the mouth 34, the legs 46 are squeezed together by the user to force the front zipper profile 36 and back zipper profile 38 to interlock as the slider 16 moves from the first end 40 along the zippered closure 14 to the second end 42, thereby closing the zippered closure 14. After the slider 16 has interlocked the front and back profiles 36 and 38 of the zippered closure 14, the ball-shaped enlargement 60 is seated in opening 62, which accommodates the enlargement 60 at the distal end of the arm 56. This prevents the enlargement 60 from exerting separation pressure on the top edge 43 of the zippered closure 14, after the zippered closure 14 is closed.

Figure 6:
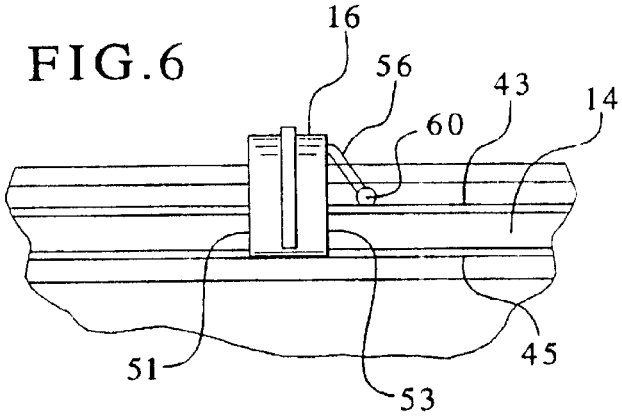
FIG. 6 is a plan view of the slider of an embodiment of the present invention.
Figure 7:
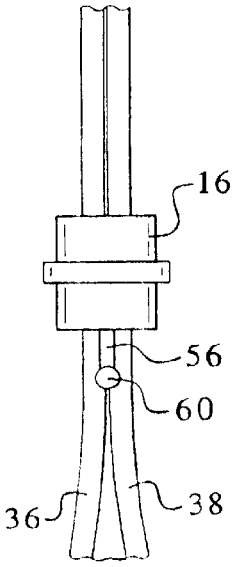
FIG. 7 is a top view of the slider of an embodiment of the present invention shown in FIG. 6.

FIGS. 6 and 7 show the slider 16 with arm 56 separating the front and back profiles 36 and 38 of the zippered closure 14. As the slider 16 is moved from the second end 42 to the first end 40 of the zippered closure 14, the enlargement 60 exerts pressure on the top edge 43 of the zippered closure 14, facilitating separation between the front and back profiles 36 and 38.

Figure 8:
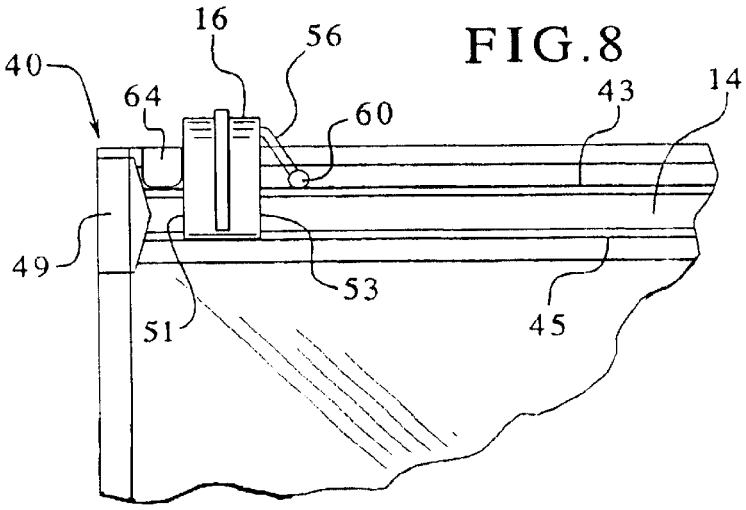
FIG. 8 is a plan view of the slider of an embodiment of the present invention.

When the slider 16 reaches the first end 40 of the zippered closure 14, it encounters the seal 64 (FIG. 8). The slider 16 slides over and rests atop the seal 64. The arm 56 contacts the seal 64 to prevent the slider 64 from sliding off of the first end 40 of the zippered closure 14.

Figure 9:
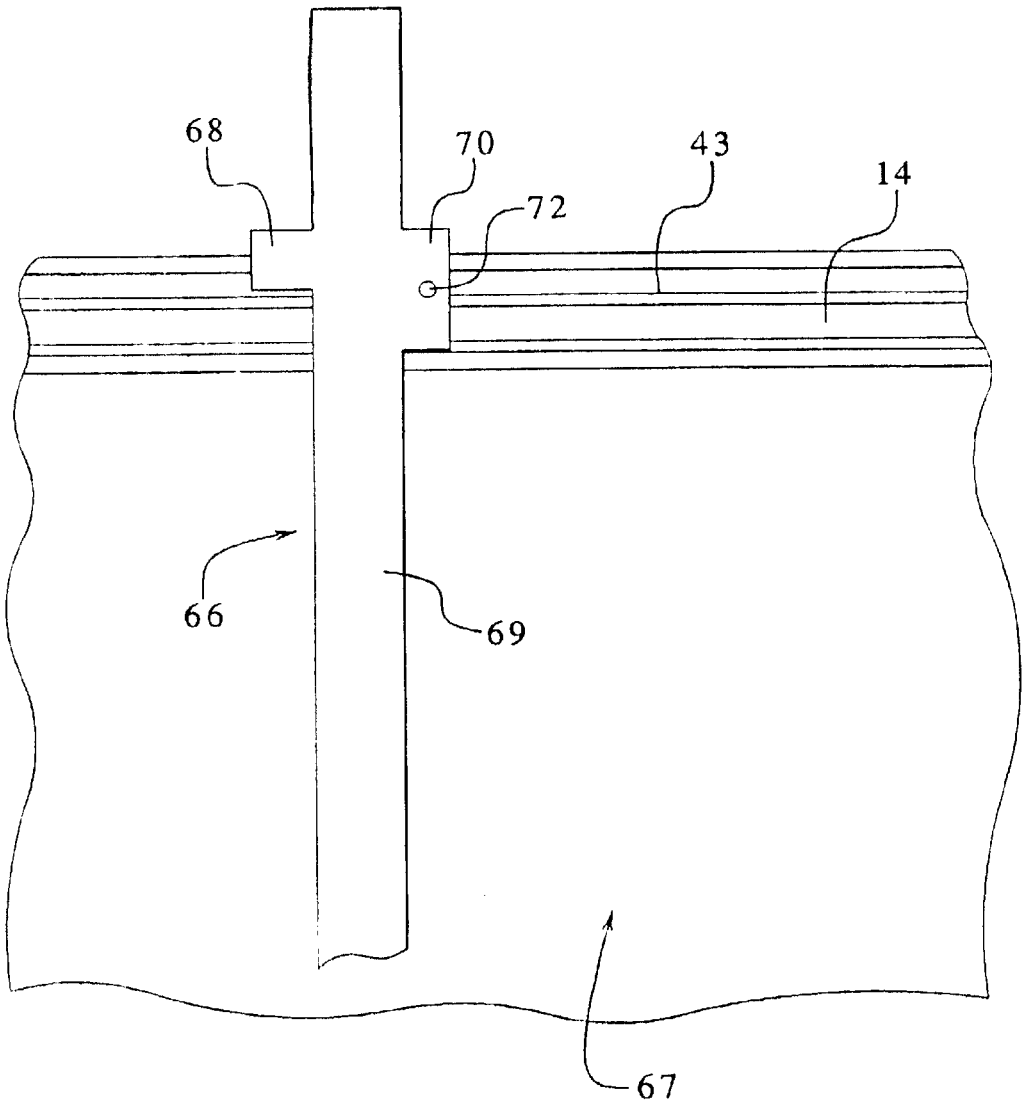
FIG. 9 is a top schematic plan view of a method of manufacturing a bag in accord with an embodiment of the present invention.

FIG. 9 shows a preferred method by which the seal 64 and the opening 62 are created during manufacture of the bag 12. A cross-sealer 66 contacts bag film 67 and seals the side edges 30 along the length of the bag 12. One cycle of the cross-sealer 66 creates the left side edge of one bag 12, and the right side edge of the succeeding bag 12 in the continuous film 67. The cross-sealer 66 is preferably a heat sealer. The cross-sealer includes a bar 69.

The cross-sealer 66 heat seals the front 18 and back 20 together at their inner surfaces 22 and 26. The cross-sealer 66 is heated to approximately 300° F. To create separate bags 12, the film 67 is cut along the center of the length of the heat seal created by the cross-sealer 66. The cutting operation (not shown) may occur at any suitable place in the process.

The cross-sealer 66 has a seal creating portion 68 and an opening creating portion 70 either integral with or attached to the bar 69. The seal creating portion 68 and opening creating portion 70 are aligned such that they create the seal 64 and opening 62 in the succeeding bags 12 along the film 67. The sealing portion 68 heat seals the front and back 18 and 20 of the bag 12 to create the seal 64. The opening creating portion 70 includes a pin 72 that burns the opening 62 into the bag 12.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A recloseable bag, the bag having a mouth and comprising:

a zippered closure at the mouth, the zippered closure having a first end and a second end, the bag having an opening above a top edge of the zippered closure at the second end;

a slider having an outer edge and seated on the zippered closure, the slider movable along the zippered closure; and an arm connected to and extending away from the slider outer edge, the arm having an enlargement at a distal end thereof, the enlargement securable in the opening.

2. The bag of claim 1, wherein the enlargement exerts a separation pressure on only the top edge to open the zippered closure when the slider is moved along the zipper closure.

3. The bag of claim 2, wherein the enlargement does not penetrate the zippered closure.

4. The bag of claim 1, wherein the enlargement is substantially spherical and the opening is substantially circular.

5. The bag of claim 1, wherein the enlargement is triangular.

6. The bag of claim 1, wherein the bag includes a seal at the mouth of the bag at the first end of the zippered closure.

7. The bag of claim 1 wherein the slider is prevented from moving along the zippered closure when the enlargement is secured in the opening.

8. The bag of claim 7 wherein the bag is substantially leakproof when the enlargement is secured in the opening.

9. A slider for a recloseable bag, the bag having a mouth, and a zippered closure at the mouth, the zippered closure having a top edge, the slider movable along the zippered closure, the slider comprising:

a body composed of a pair of opposing legs extending from opposite sides of a rounded portion, the legs seated on the zipper closure, the body having an outermost edge; and an arm extending from the outermost edge downwardly away from the body, the arm having a distal end spaced a distance away from the body, the distal end adapted to engage only the top edge of the zippered closure when the slider is moved along the zipper closure.

10. The slider of claim 9, wherein the distal end of the arm includes an enlargement.

11. The slider of claim 10, wherein the enlargement is ball-shaped.

12. The slider of claim 10, wherein the enlargement is triangular.

13. The slider of claim 10 wherein the enlargement provides a separation pressure upon only the top edge to open the zipper closure.

14. The slider of claim 13 wherein the enlargement does not penetrate the zipper closure.

15. A method of opening and closing a recloseable bag, the bag having a mouth, a zippered closure at the mouth, the zippered closure having a top edge, a slider seated on the zipper closure, the slider moveable along the zippered closure and having an outer edge and an arm with a distal end extending from and downwardly away from the slider outer edge the method comprising:

engaging the top edge of the zippered closure with the distal end while sliding the slider along the zippered closure; and exerting a separation pressure upon only the top edge of the zippered closure with the distal end during said sliding.

16. The method of claim 15, wherein the zippered closure includes a front profile and a back profile, the method further comprising separating with the separation pressure the front profile from the back profile.

17. The method of claim 15, wherein the zippered closure has an end and the bag has an opening above the top edge of the end, the method further comprising seating distal end in the opening.

18. The method of claim 15, wherein the distal end does not penetrate the zippered closure.

19. A method of opening and closing a recloseable bag, the bag having a mouth, a zippered closure at the mouth, the zippered closure having an end, the bag having an opening above the end, a slider seated on the zippered closure, the slider moveable along the zippered closure and having an outer edge and an arm with an enlargement at a distal end thereof, the arm connected to and extending downwardly away from the slider outer edge, the method comprising:

closing the zippered closure by sliding the slider to the end of the zippered closure; and securing the enlargement in the opening to prevent movement of the slider along the zippered closure.

20. The method of claim 13 wherein the zippered closure has a top edge, the method further comprising sliding the slider away from the end; and exerting with the enlargement a separation pressure upon only the top edge to open the zippered closure.

21. The method of claim 20 wherein the enlargement does not penetrate the zippered closure.

* * * * *